US011621490B2

(12) United States Patent
Liang

(10) Patent No.: US 11,621,490 B2
(45) Date of Patent: Apr. 4, 2023

(54) ANTENNA STRUCTURE AND DEVICE FOR METAL ENVIRONMENT

(71) Applicant: Securitag Assembly Group Co., Ltd., Taichung (TW)

(72) Inventor: Kai-Jun Liang, Taichung (TW)

(73) Assignee: Securitag Assembly Group Co., Ltd., Taichung (TW)

( * ) Notice: Subject to any disclaimer, the term of this patent is extended or adjusted under 35 U.S.C. 154(b) by 45 days.

(21) Appl. No.: 17/343,716

(22) Filed: Jun. 9, 2021

(65) Prior Publication Data

US 2022/0069435 A1 Mar. 3, 2022

(30) Foreign Application Priority Data

Aug. 28, 2020 (TW) ..... 109129513

(51) Int. Cl.
*H01Q 1/38* (2006.01)
*H01Q 9/04* (2006.01)
*H01Q 1/22* (2006.01)

(52) U.S. Cl.
CPC ..... *H01Q 9/0421* (2013.01); *H01Q 1/2225* (2013.01); *H01Q 1/38* (2013.01)

(58) Field of Classification Search
CPC ..... H01Q 9/0421; H01Q 1/2225; H01Q 1/38; H01Q 9/42; H01Q 13/10; H01Q 1/36
See application file for complete search history.

(56) References Cited

U.S. PATENT DOCUMENTS 6,218,990 B1 4/2001 Grangeat et al.
8,576,124 B2 11/2013 Popugaev et al.
8,950,683 B2 2/2015 Liu et al.
(Continued)

FOREIGN PATENT DOCUMENTS

CN 103679247 A 3/2014
CN 203644063 U 6/2014
(Continued)

OTHER PUBLICATIONS

Extended European search report, dated Feb. 4, 2022, in corresponding application EP 21187817 8.
(Continued)

*Primary Examiner* — Ab Salam Alkassim, Jr.
*Assistant Examiner* — Anh N Ho
(74) *Attorney, Agent, or Firm* — Chen Yoshimura LLP

(57) ABSTRACT

The present invention provides an antenna structure for metal environment. The antenna structure comprises a radiating conductor, a first ground conductor, and a second ground conductor. The radiating conductor comprises a first opening circuit, and a second opening circuit, in which the first opening circuit is opened at a first side of the radiating conductor, and the second opening circuit is opened at a second side of the radiating conductor. The first ground conductor is electrically coupled to a third side of the radiating conductor while the second ground conductor is electrically coupled to a fourth side of the radiating conductor. Alternatively, the present invention further provides an antenna device by folding the antenna structure having RFID chip electrically attached thereon to cover a substrate, whereby the antenna device could be accessed in a metal environment.

16 Claims, 12 Drawing Sheets

(56) References Cited

U.S. PATENT DOCUMENTS

| | | | | |
|---|---|---|---|---|
| 10,176,422 | B2 | 1/2019 | Ennabli et al. | |
| 10,248,904 | B2 * | 4/2019 | Akamatsu | G06K 19/07794 |
| 10,289,945 | B1 * | 5/2019 | Ramirez | G06K 19/07775 |
| 10,339,437 | B2 | 7/2019 | Sugimura et al. | |
| 10,755,161 | B2 | 8/2020 | Zhu et al. | |
| 11,087,198 | B2 * | 8/2021 | Zhou | G06K 19/07767 |
| 2007/0229276 | A1 | 10/2007 | Yamagajo et al. | |
| 2009/0160653 | A1 | 6/2009 | Yeh et al. | |
| 2011/0315774 | A1 | 12/2011 | Baba et al. | |
| 2014/0284388 | A1 * | 9/2014 | Liu | G06K 19/07786 216/13 |
| 2016/0140368 | A1 | 5/2016 | Kai | |

FOREIGN PATENT DOCUMENTS

| | | | | |
|---|---|---|---|---|
| CN | 104751223 | A | * | 7/2015 |
| CN | 104751223 | B | | 6/2018 |
| JP | 2012253700 | A | * | 12/2012 |
| WO | 2011141860 | A1 | | 11/2011 |

OTHER PUBLICATIONS

Taiwanese Office Action, dated Dec. 24, 2021, in a counterpart Taiwanese patent application, No. TW 109129513.

* cited by examiner

ANTENNA STRUCTURE AND DEVICE FOR METAL ENVIRONMENT

This application claims the benefit of Taiwan Patent Application Serial No. 109129513, filed Aug. 28, 2020, the subject matter of which is incorporated herein by reference.

BACKGROUND OF INVENTION

1. Field of the Invention

The present invention provides a design of antenna structure, and more particularly, to an antenna structure and device that are capable of increasing bandwidth of operation frequency no matter the antenna structure and device is interrogated by the interrogator from the front surface of the metal object where the antenna structure and device is arranged or back surface of the metal object opposite to the front surface.

2. Description of the Prior Art

Conventionally, when the RFID device is operated under ultra high frequency (UHF) range, due to the characteristic of electromagnetic scattering and coupling, the RFID is sensitive to the liquid and metal environment where it is arranged. The metal or liquid environment could induce the problem that make the RFID device inoperative, if there has no proper design on the RFID device.

According to the electromagnetic theory, when the uniform electromagnetic wave is obliquely projected onto a flat antenna formed by a good conductor, a reflection phenomenon from the surface of the good conductor will be generated because there has no electromagnetic wave inside the good conductor thereby causing the RFID becoming inoperative. In addition, since the metal object to which the RFID device is attached will also reflect the electromagnetic wave, it will also cause destructive interference due to the phase variation between the incident electromagnetic wave and reflected electromagnetic wave.

In addition to the above-mentioned reasons, according to theory of current minor, when a dipole antenna is arranged onto the top of the metal object, e.g. on the top surface of the metal object, a reverse current is induced on the bottom surface opposite the top surface, whereby electromagnetic wave is eliminated. Since the RFID device is easily affected by the metal object, the RFID device can't be utilized on the metal object effectively.

According to the incident and reflective theory of wavelength, when the RFID tag is arranged at location having half wavelength away from the metal surface, the amplitude of incident wave and reflective wave are almost zero such that the energy of incident wave or reflective wave becomes weak. When the RFID tag is arranged at location having quarter wavelength away from the metal surface, a constructive interference will be generated between the incident wave and reflective wave. Although quarter wavelength has better signal effect, practically, the RFID tag will not be arranged at location having quarter wavelength away from the metal surface of metal object due to the volume limitation. In addition, when the distance is reduced between the RFID tag and metal surface, the energy storage will be increased whereby the radiating energy is difficult to be emitted. Therefore, when the UHF RFID tag is close to the metal object, how to improve the interrogating distance is an important issue that should be solved.

Please refer to FIGS. 1A and 1B, which illustrate conventional antenna structure and device under UHF frequency range. In the FIG. 1A, the antenna structure 10 is a planar inverted-F antenna (PIFA). The antenna structure 10 is adhered on the rectangular surface of the substrate 11 having cuboid structure, wherein a first antenna segment 100 of the antenna structure 10 is arranged onto a first surface 110 of the substrate 11, a second antenna segment 101 is adhered to a lateral surface 111 connected to the first surface 110, and the third antenna segment 102 of the antenna structure 10 is adhered to a second surface 112 connected to the lateral surface 111. The second surface 112 is opposite the first surface 110. During the operation, the dimension of the short circuit 106 and power supplying circuit 107 could be adjusted for matching the impedance between the antenna structure 10 and RFID IC chip 105 arranged at lateral surface 111.

According to the conventional art, the method for overcoming the metal effect is to add a medium between the RFID tag and metal surface on which the RFID tag attached so as to increase the distance between the RFID tag and metal surface thereby reducing the metal effect. Nevertheless the conventional PIFA can be utilized in the metal environment, the accessing range of interrogation or the bandwidth is short. Therefore, there is a need for providing a RFID device having characteristics of being operated in the metal environment with broadened operation frequency range so as to solve the above-mentioned drawbacks of the conventional RFID devices.

SUMMARY OF THE INVENTION

The present invention provides an antenna structure having radiating conductor and ground conductor electrically coupled to the radiating conductor wherein an hollow structure is formed inside the radiating conductor for shortening wavelength resonating with the antenna structure thereby reducing the volume of the antenna structure The present invention provides an antenna structure and device, wherein at least four surfaces of the substrate have antenna structure formed thereon. In one embodiment, antenna structure can be further formed on the five surfaces or six surfaces of the substrate. In one embodiment, in addition to covering the surfaces along the length direction of the substrate by the radiating conductor, the radiating conductor further has extended conductor part for covering lateral surfaces of substrate along the width direction such that the radiating surface area is increased whereby the gain of antenna structure is improved to increase the interrogating distance between the RFID reader and RFID tag.

In one embodiment, the present invention provides an antenna structure for metal environment comprising a radiating conductor comprising a first hollow structure and a second hollow structure, and a ground conductor electrically connected to the radiating conductor, wherein one end of the first hollow structure is connected to a first lateral side of the radiating conductor, and one end of the second hollow structure is connected to a second side of the radiating conductor, and the ground conductor.

In one embodiment, the present invention provides an antenna structure for metal environment comprising a radiating conductor comprising a first hollow structure and a second hollow structure, and a ground conductor having first ground conductor and a second ground conductor, wherein one end of the first hollow structure is opened a first lateral side of the radiating conductor, one end of the second hollow structure is opened at a second side of the radiating conductor, and the ground conductor, the first ground conductor is electrically connected to a third lateral side of the radiating conductor, and the second ground conductor is electrically connected to a fourth lateral side of the radiating conductor.

In one embodiment, the present invention provides an antenna device for metal environment. The antenna device comprises a radio frequency chip, a radio frequency chip, a substrate and an antenna structure. The substrate is configured to have a first surface, a first lateral surface and a second lateral surface respectively connected to two lateral sides of the first surface along a first direction, and extended along a third direction, a third lateral surface and a fourth lateral surface respectively connected to two lateral sides of the first surface along a second direction, and extended along the third direction, and a second surface arranged opposite to the first surface along the third direction, and connected to the first lateral surface, the second lateral surface, the third lateral surface and the fourth lateral surface. The antenna structure is formed onto the substrate and electrically coupled to the radio frequency chip and further comprises a radiating conductor, a ground conductor, and a connecting conductor. The radiating conductor is formed on the first surface and comprises a first hollow structure and a second hollow structure, wherein one end of the first hollow structure is connected to a first lateral side of the radiating conductor, and one end of the second hollow structure is connected to a second side of the radiating conductor. The ground conductor is formed on the second surface, and is electrically connected to the radiating conductor. The connecting conductor is electrically coupled to the ground conductor and the radiating conductor.

In one embodiment, the present invention provides an antenna device for metal environment. The antenna device comprises a radio frequency chip, a radio frequency chip, a substrate and an antenna structure. The substrate is configured to have a first surface, a first lateral surface and a second lateral surface respectively connected to two lateral sides of the first surface along a first direction, and extended along a third direction, a third lateral surface and a fourth lateral surface respectively connected to two lateral sides of the first surface along a second direction, and extended along the third direction, and a second surface arranged opposite to the first surface along the third direction, and connected to the first lateral surface, the second lateral surface, the third lateral surface and the fourth lateral surface. The antenna structure comprises a radiating conductor comprising a first hollow structure and a second hollow structure, and a ground conductor having first ground conductor and a second ground conductor, wherein one end of the first hollow structure is opened a first lateral side of the radiating conductor, one end of the second hollow structure is opened at a second side of the radiating conductor, and the ground conductor, the first ground conductor is electrically connected to a third lateral side of the radiating conductor, and the second ground conductor is electrically connected to a fourth lateral side of the radiating conductor.

In one embodiment, the present invention provides an antenna device for metal environment. The antenna device comprises a radio frequency chip, a substrate having six surfaces, and an antenna structure. The antenna structure is formed onto the substrate and electrically coupled to the radio frequency chip, and the antenna structure further comprises a radiating conductor, a ground conductor and a connecting conductor, wherein the radiating conductor comprises a first hollow structure having one end opened at a first lateral side of the radiating conductor, and a second hollow structure having one end opened at a second side of the radiating conductor, and the connecting conductor is connected to the ground conductor and the radiating conductor, wherein the antenna structure is formed onto at least four surfaces of the substrate.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to an antenna structure and device utilized in metal environment. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 2:
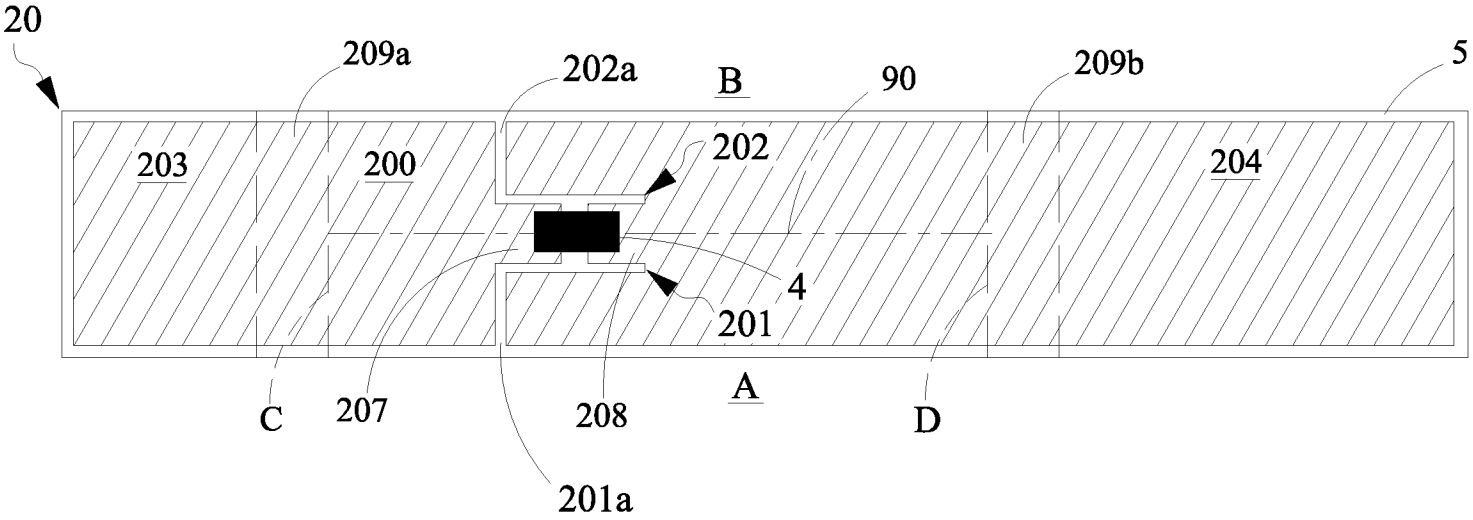
FIG. 2 illustrates antenna structure for metal environment according to one embodiment of the present invention.

Please refer to FIG. 2, which illustrates antenna structure for metal environment according to one embodiment of the present invention. In the present embodiment, the material for making the antenna structure 20 could be, but should not limited to copper, silver, and aluminum. The metal material is printed as a layer onto a flexible substrate 5. The flexible substrate 5 is also an insulation substrate. The material for making the flexible substrate 5 can be, but should not be limited to, polyethylene terephthalate (PET) or Polyimide (PI). In the present embodiment, the antenna structure 20 is a UHF antenna structure.

The antenna structure 20 comprises a radiating conductor 200, a ground conductor having first ground conductor 203 and a second ground conductor 204. The radiating conductor 200 has a first hollow structure 201 and a second hollow structure 202 formed within the radiating conductor, wherein one end of the first hollow structure 201 extends to a first side A of the radiating conductor 200 such that an opening 201*a* corresponding to the first hollow structure 201 is formed at the first side A while one end of the second hollow structure 202 extends to a second side B of the radiating conductor 200 such that an opening 202*a* corresponding to the second hollow structure 202 is formed at the second side B.

In the present embodiment, the first hollow structure 201 and the second hollow structure 202 formed inside the radiating conductor 200 are void areas without the metal material and are symmetrically arranged at two separated side of a central axis 90 passing through the centers of third side C and fourth side D of the radiating conductor 200. It is noted that the shape of each first hollow structure 201 and second hollow structure 202 is not limited to the L-shaped structure shown in FIG. 2. Since the first and the second hollow structures 201 and 202 are formed inside the radiating conductor 200, the antenna structure can be resonated at condition that the conductive path of the antenna structure is equal or less than half wavelength of the interrogating wavelength, wherein the conductive path of the antenna structure, such as CP shown in FIG. 3C, is referred the conductive path of electrical current initiated by electromagnetic energy between the RFID reader and antenna structure. It is noted that the conductive path is theoretically equal to c/f, wherein c represents light speed, i.e. $3\times10^8$ m/sec and f represents interrogating frequency. In one embodiment, the antenna structure 20 having conductive path equal to quarter wavelength. For example, if the interrogating frequency is 925 MHz, the quarter wavelength is around 81 mm to 89 mm, depending on material and environmental factors.

By the layout arrangement of the first and second hollow structures 201 and 202 inside the radiating conductor 200, a first power supplying conductive element 207 representing positive electrode, for example, and a second power supplying conductive element 208 representing negative electrode, for example, can be formed such that the radio frequency chip 4 can be electrically coupled to the first power supplying conductive element 207 and the second power supplying conductive element 208 whereby the radio frequency chip 4 can be interrogated with the RFID reader through the antenna structure 20.

In the embodiment shown in FIG. 2, the antenna structure 20 further comprises a first connecting conductor 209*a* and a second connecting conductor 209*b*, wherein the first connecting conductor 209*a* is electrically connected to a first ground conductor 203 and the third side C of the radiating conductor 200, and the second connecting conductor 209*b* is electrically connected to the second ground conductor 204 and the fourth side D of the radiating conductor 200. In the present embodiment, the radiating conductor 200, the first and second connecting conductors 209*a* and 209*b*, and the first and second ground connectors 203 and 204 are integrated into a single conductive structure.

Figure 3A:
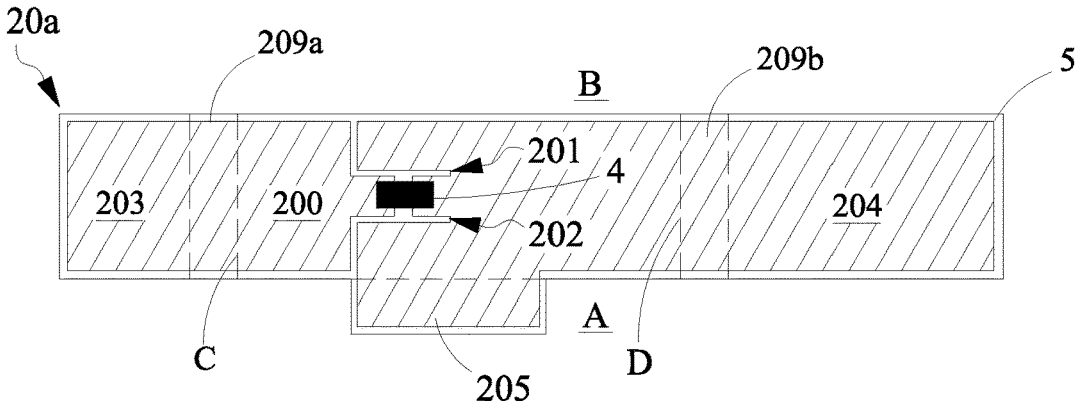
FIGS. 3A to 3C respectively illustrate different embodiment of the antenna structure of the present invention.
Figure 3B:
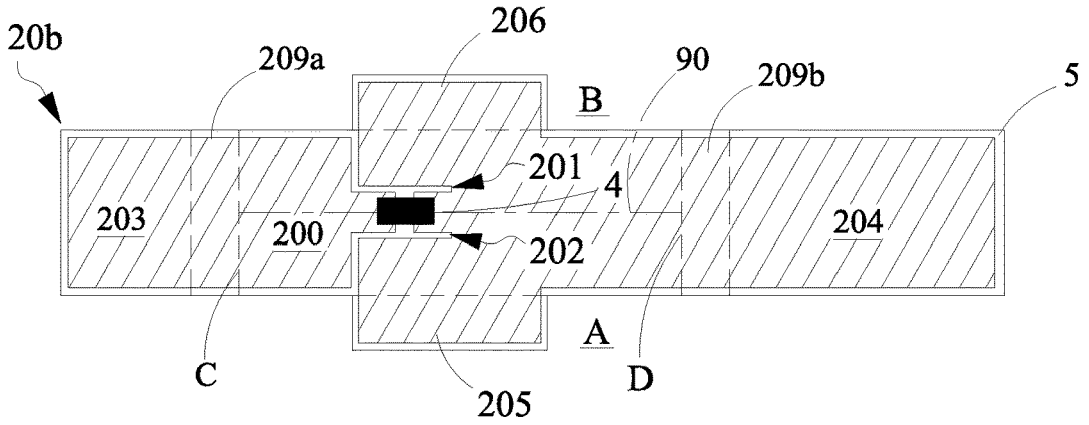
Figure 3C:
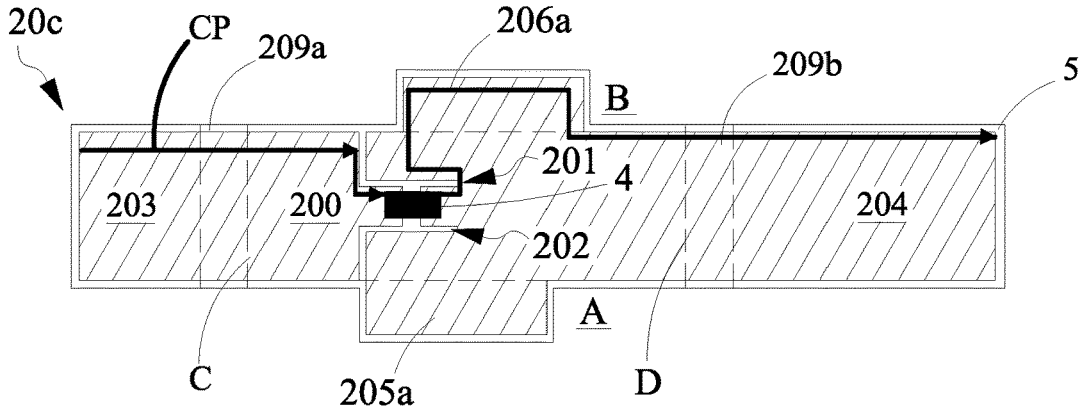

Please refer to FIGS. 3A and 3C respectively illustrating antenna structures according to different embodiment of the present invention. In the embodiment shown in FIG. 3A, basically it is similar to the FIG. 2. The different part is that the antenna structure 20*a* further comprises a first conductive part 205 electrically connected to, and preferably physically abutting, the first side A of the radiating conductor 200. The first conductive part 205 has a geometric shape without specific limitation. In the present embodiment, the shape of the first conductive part 205 is rectangular shape. The first conductive part 205 is formed by metal material such as aluminum, copper or silver, for example.

In another embodiment, such as the antenna structure shown in FIG. 3B, it is basically similar to the antenna structure shown in FIG. 3A. The different part is that the antenna structure 20*b* further comprises a second conductive part 206 electrically connected to, and physically abutting, the second side B of the radiating conductor 200. The second conductive part 206 has a geometric shape without specific limitation. In the present embodiment, the shape of the second conductive part 206 is rectangular shape. The second conductive part 206 is formed by metal material such as aluminum, copper or silver, for example. It is also noted that, the first and second conductive parts 205 and 206 are symmetrically arranged abutting two sides A and B of the central axis 90 of the radiating conductor 200.

Alternatively, please refer to FIG. 3C, the antenna structure in the present embodiment is similar to the antenna structure shown in FIG. 3B, the different part is that the first and second conductive parts 205*a* and 206*a* are not symmetrically arranged at the first and second sides A and B. In the present embodiment, the second conductive part 206*a* is right-shifted a specific distance from the first conductive part 205*a*. Alternatively, the second conductive part 206*a* left-shifted a specific distance from the first conductive part 205*a* is also available. It is noted that although the first and second conductive parts have the same shape as each other in FIGS. 3B and 3C, alternatively, the first and second conductive parts may have different shape from each other.

Please refer to the Friis free-space formula (1) related the broadcast of electromagnetic wave in the free space illustrated blow, wherein the $P_{th}$ is referred to the lowest start power of IC chip, $\lambda$ is referred to the wavelength of the center frequency, $G_r$ is gain of the antenna structure, tis power transmission coefficient, $P_t$ is accessing power strength of the reader, and $G_t$ is the maximum gain of the antenna of reader. It is noted that $G_r$ and $\tau$ are vital parameters for designing the antenna structure.

$$r = \frac{\lambda}{4\pi}\sqrt{\frac{P_t G_t G_r \tau}{P_{th}}} \tag{1}$$

In addition, the equation (2) shown below represents gain $G_r$ of the antenna structure. According to the equation, the gain $G_r$ is positive correlation to antenna area Ae. If the antenna area is larger, the gain $G_r$ can be strengthened to increase the interrogation distance.

$$G = \frac{4\pi A_e}{\lambda^2} \tag{2}$$

According to the equation shown above, it is noted that the antenna area shown in FIGS. 3A to 3C can be increased by adding the first conductive part 205, 205*a* and the second conductive part 206, 206*a* thereby increasing the interrogating distance. In addition, since the first conductive part 205, 205*a*, and second conductive part 206, 206*a* strengthen the gain of antenna, it can also solve the problem of interrogation between the RFID tag arranged at the front surface of the metal object and RFID reader interrogating RFID tag from the back side of the metal object.

Figure 4:
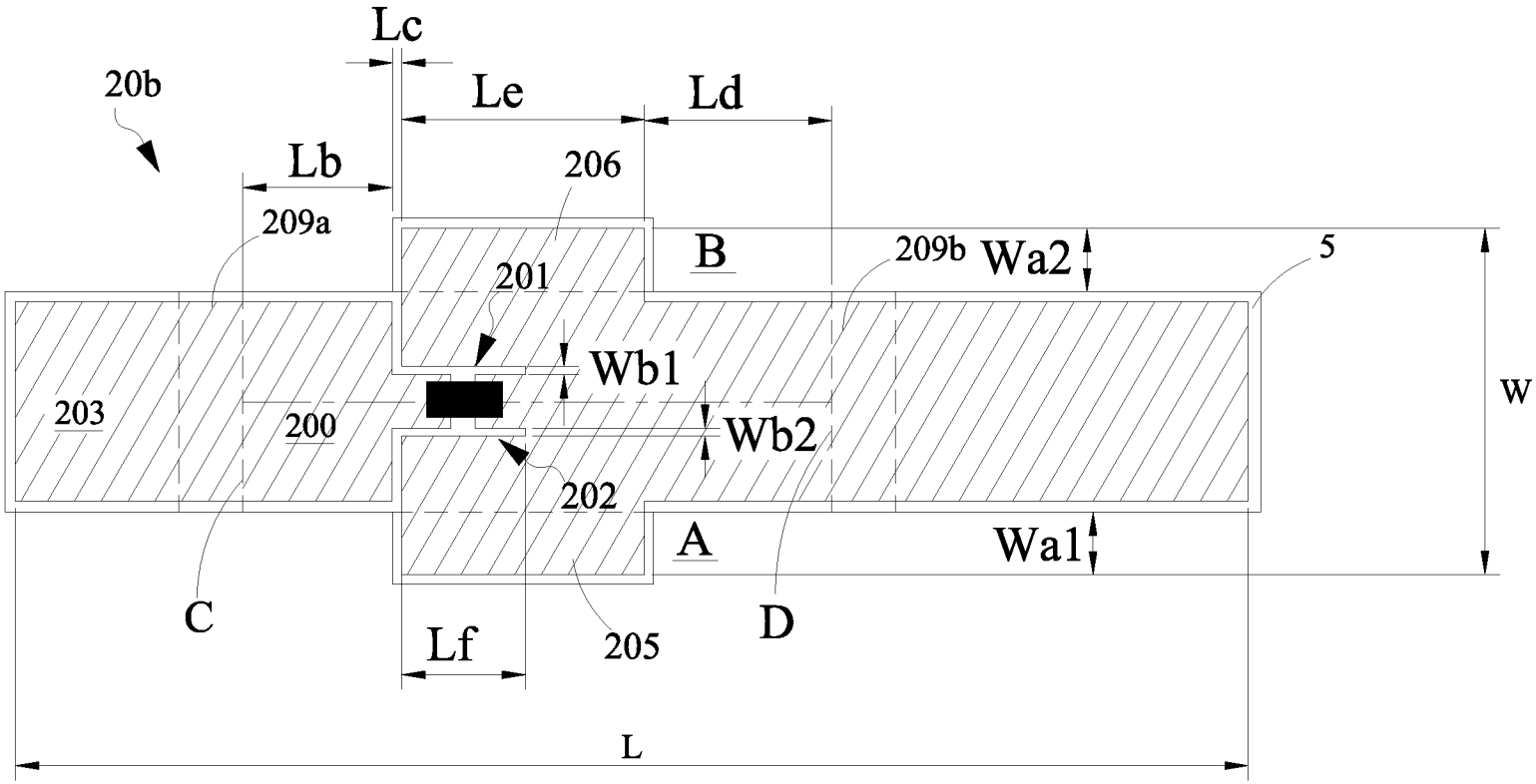
FIG. 4 illustrates a dimension relationship of an antenna structure according to one embodiment of the present invention.

Regarding to the dimension of the antenna structure, it is explained by utilizing the antenna structure shown in FIG. 3B as an example. Please refer to FIG. 4, the length L of the radiating conductor 200 is ranged between 52~185 mm, the width W of the antenna structure 20*b* is ranged between 10~70 mm. The length Lf of the first and second hollow structures 201 and 202 are respectively ranged between 2~60 mm. The length Lb is ranged between 1~20 mm. The length Lc is ranged between 0.5~20 mm. The length Ld is ranged between 3~40 mm. The length Le is ranged between 3~40 mm. The width Wa1 and Wa2 of the first and second conductive parts 205 and 206 are ranged from 0.5~15 mm while the width Wb1 and Wb2 of the first hollow structure 201 and second hollow structure 202 are respectively ranged between 0.5~35 mm. It is noted that the dimension of each part of the antenna structure is determined according to the user's need, and the dimension range described above will not be a limitation of the present invention.

Figure 5A:
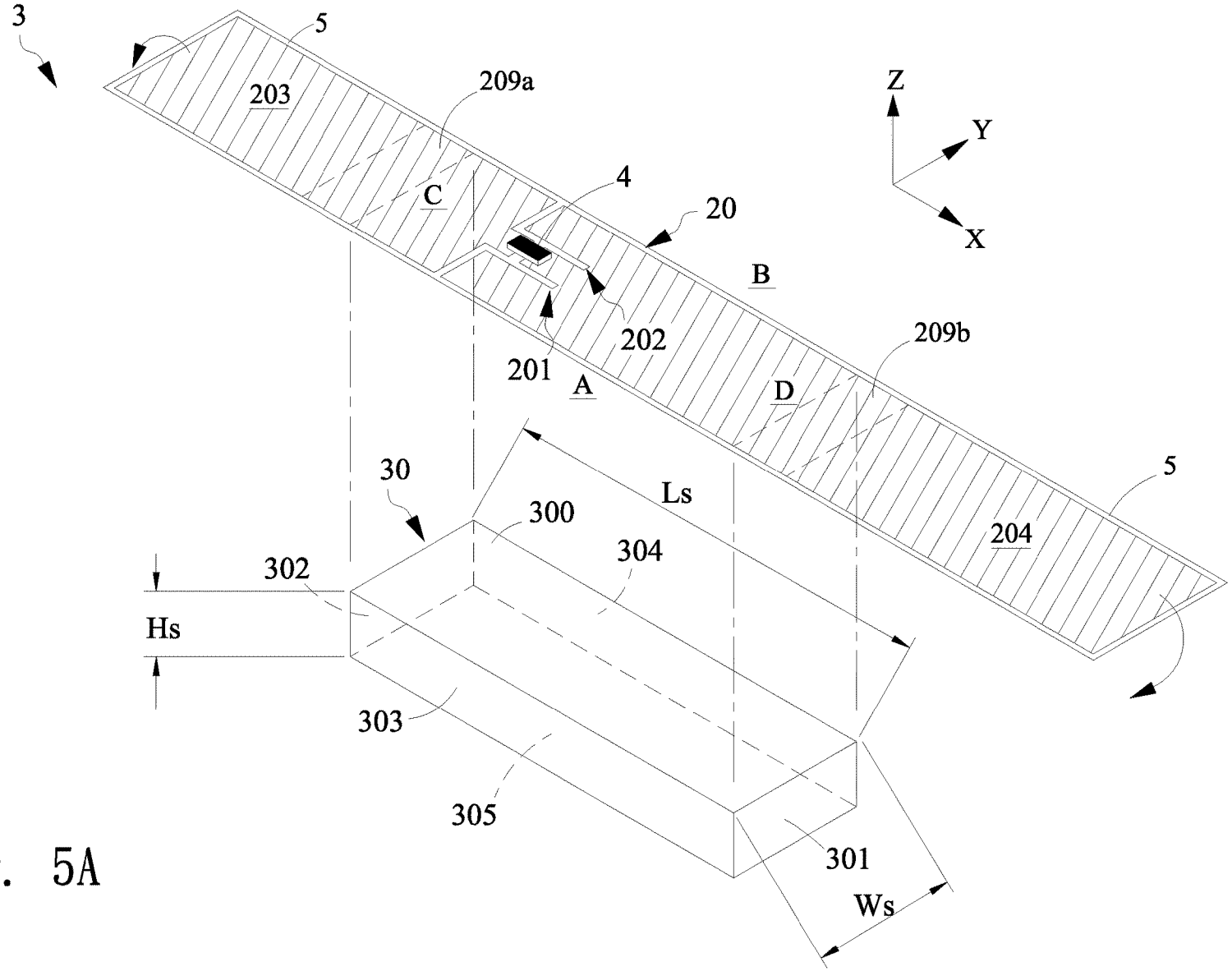
FIGS. 5A and 5B respectively illustrate an explosive view of an antenna device and a perspective view of an antenna device according to one embodiment of the present invention.
Figure 5C:
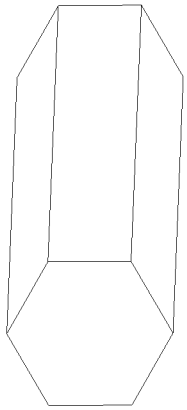
FIG. 5C illustrates a perspective view of the substrate according to one embodiment of the present invention.
Figure 5B:
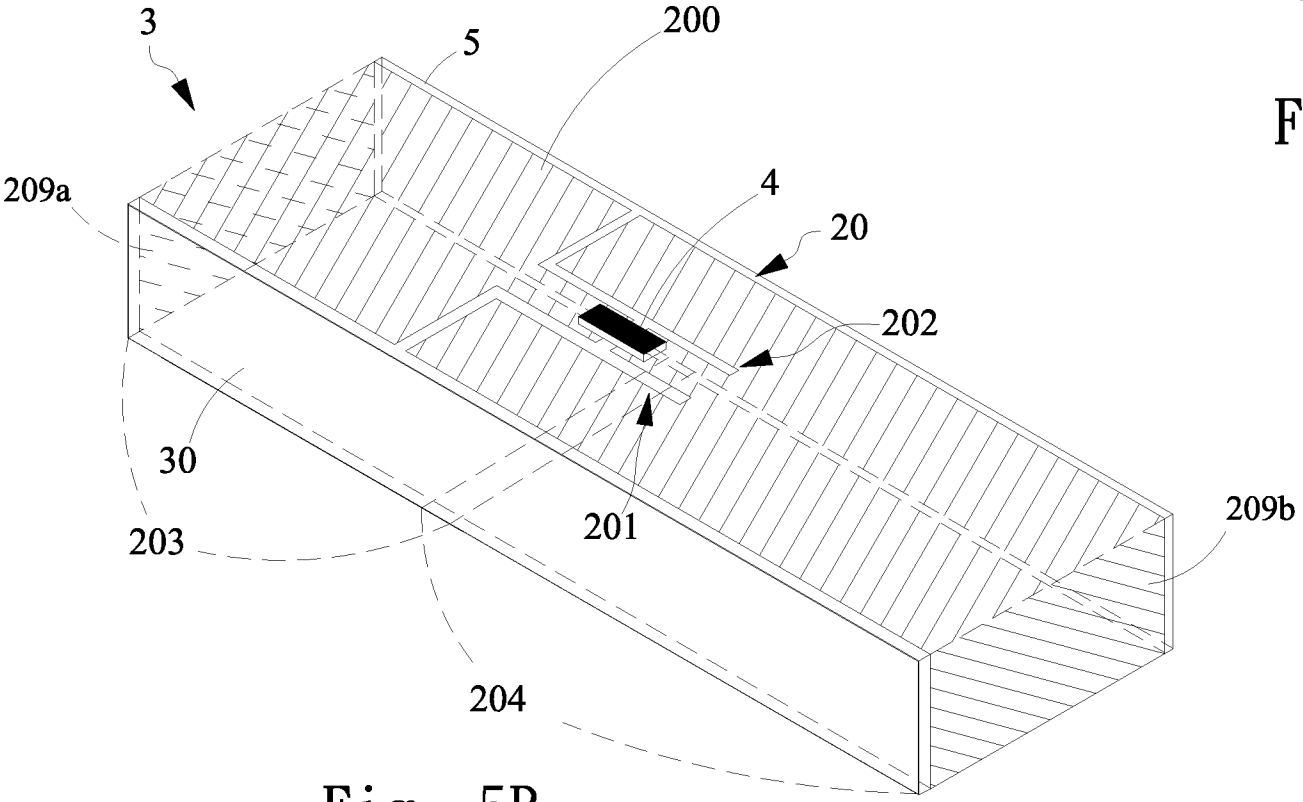
Figure 5E:
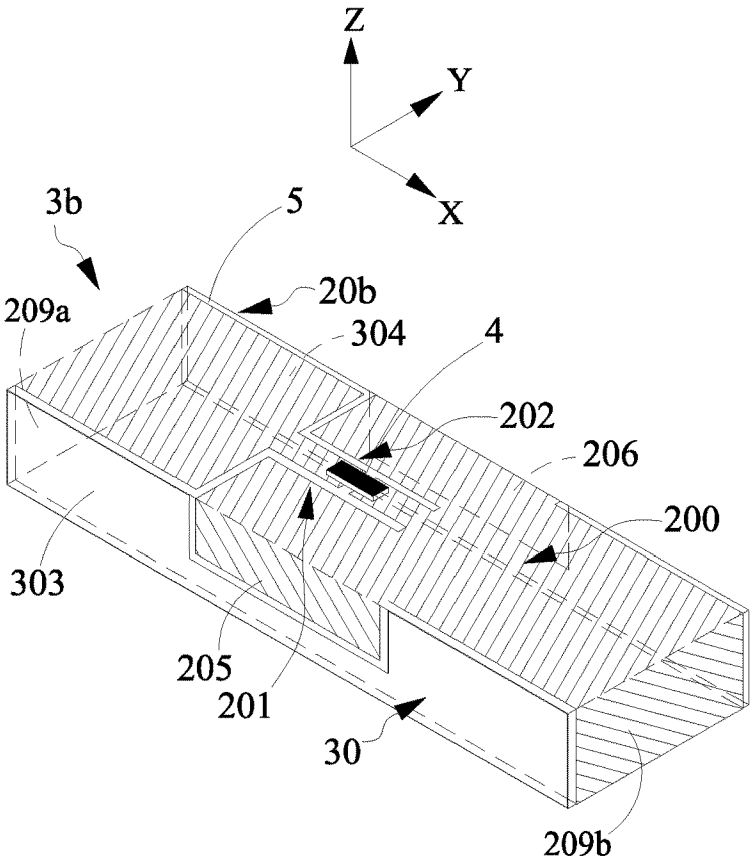
FIG. 5E illustrates an antenna device formed by the antenna structure shown in FIG. 3B.

Please refer to FIGS. 5A and 5B which respectively illustrate an exploded view and perspective view of the antenna device according to one embodiment of the present invention. The antenna device 3 has a substrate 30 and an antenna structure 20. The substrate 30 can be a non-metal material such as polymer substrate, or PCB substrate. The substrate 30 is a cubic structure having a plurality of surfaces such as cuboid or cube, for example. Alternatively, the substrate 30 can also be a cubic structure shown in FIG. 5C. In the present embodiment, the substrate is a hexahedron substrate.

The substrate 30 has a first surface 300, a first lateral surface 301 and a second lateral surface 302 respectively connected to two lateral sides of the first surface 300 which are spaced apart along a first direction (X), and extending along a third direction (Z), a third lateral surface 303 and a fourth lateral surface 304 respectively connected to two lateral sides of the first surface 300 which are spaced apart along a second direction (Y), and extending along the third direction (Z), and a second surface 305 arranged opposite to the first surface 300 along the third direction (Z), and connected to the first lateral surface 301, the second lateral surface 302, the third lateral surface 303 and the fourth lateral surface 304. The size of the substrate 30 is determined according to user's need. In one embodiment, the length Ls of the substrate 30 is ranged between 25~75 mm, the width Ws is ranged between 8~40 mm, and the height Hs is ranged between 1~15 mm. It is noted that the dimension described above is only the exemplary embodiment, and it is not the limitation of the present invention.

The antenna structure 20 is formed onto at least four surfaces, at least five surfaces or six surfaces of the substrate 30. In one embodiment, the metal conductors are formed onto the flexible substrate 5 to form the antenna structure 20, and the antenna structure 20 is formed onto the substrate 30 by sticking the flexible substrate 5 onto the substrate. In the embodiment shown in FIGS. 5A and 5B, the antenna structure 20 further comprises the radiating conductor 200, the first and second ground conductors 203 and 204, the first connecting conductor 209*a*, and the second connecting conductor 209*b*. The radiating conductor 200 is formed onto the first surface 300. The radiating conductor 200 has a first hollow structure 201 and a second hollow structure 202. One end of the first hollow structure 201 is connected to a first side A of the radiating conductor 200 so that an opening corresponding to the first hollow structure 201 is formed at the first side A. One end of the second hollow structure 202 is connected to a second side B of the radiating conductor 200 so that an opening corresponding to the second hollow structure 202 is formed at the second side B.

The first ground conductor 203 and the second ground conductor 204 is formed onto the second surface 305. The first connecting conductor 209*a* and the second connecting conductor 209*b* are formed onto the first lateral surface 301 and the second lateral surface 302, respectively. The two sides of the first connecting conductor 209*a* are electrically connected to the first ground conductor 203 and the third side C of the radiating conductor 200, and the two sides of the second connecting conductor 209*b* is electrically connected to the second ground conductor 204 and the fourth side D of the radiating conductor 200. The features of the antenna structure 20 are the same as the embodiment shown in FIG. 2, and it will not be described hereinafter.

In one embodiment of making the antenna structure 20 shown in FIG. 5, the flexible substrate 5 having radiating conductor 200 can be stuck onto the first surface 300. After that, the flexible substrate 5 having the first connecting conductor 209*a* and the second connecting conductor 209*b* are folded to be stuck onto the first lateral side 301 and the second lateral side 302, respectively. Thereafter, the first ground conductor 203 and the second ground conductor 204 are stuck onto the second surface 305 by folding the flexible substrate 5, wherein, in the present embodiment, when the first and second ground conductors 203 and 204 are formed onto the second surface 305, a part of the first and the second ground conductors 203 and 204 are overlapped. In the embodiment shown in FIG. 5B, the first surface 300, first and second lateral surfaces 301 and 302, and the second surface 305 have part of the antenna structure 20. Although the first and second ground conductors 203 and 204 are partially overlapped with each other in the present embodiment, it is noted that the no overlapped region between first and second ground conductors 203 and 204 is also available, such as the boundaries of the first and second ground conductors 203 and 204 contacted with each other or having a distance away from each other, for example.

Figure 5D:
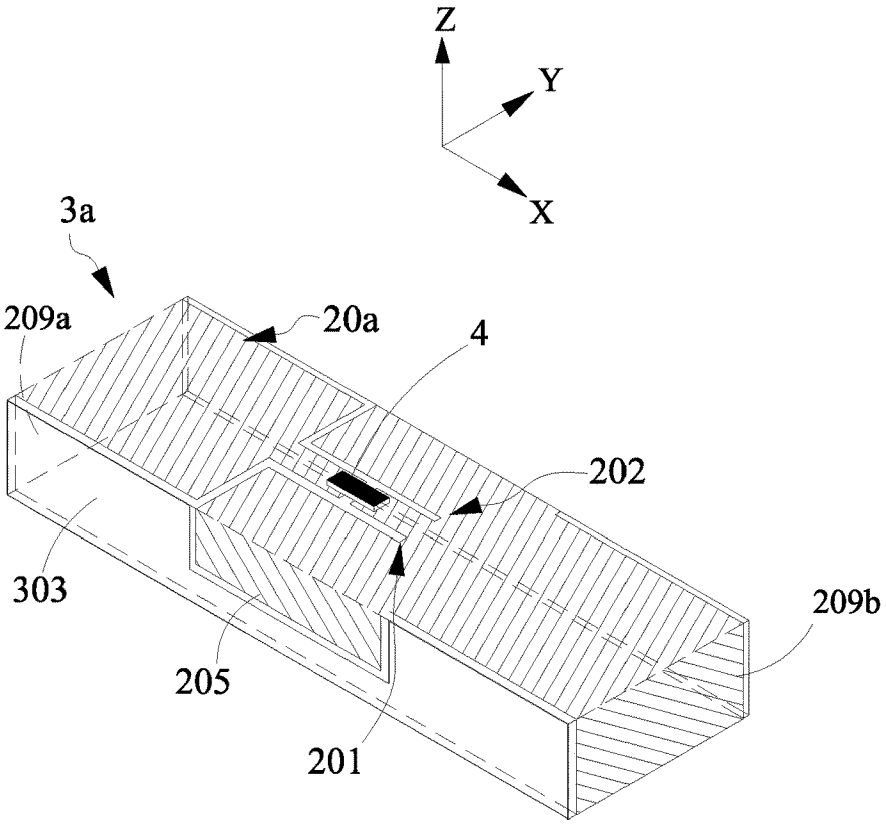
FIG. 5D illustrates an antenna device formed by the antenna structure shown in FIG. 3A.

Please refer to FIG. 5D, which illustrates an antenna device 3*a* having the antenna structure 20*a* shown in FIG. 3A. In the present embodiment, a first conductive part 205 of the antenna structure 20*a* is formed on the third surface 303 by folding the flexible substrate 5 toward the third direction (Z). Likewise, please refer to FIG. 5E, which illustrates antenna device 3*b* having antenna structure 20*b* shown in FIG. 3B. In the present embodiment, a first conductive part 205 and a second conductive part 206 are respectively formed onto the third lateral surface 303 and the fourth lateral surface 304 by folding the flexible substrate 5 toward the third direction (Z). It is noted that since the antenna devices 3*a* and 3*b* shown in FIGS. 5D and 4E are formed on the five or six surfaces of the substrate 30, the radiating area is increased so as to increase the interrogating distance of the antenna structures 20*a* and 20*b* such that the antenna devices 3*a* and 3*b* can be stuck onto any location of the metal object.

Figure 6A:
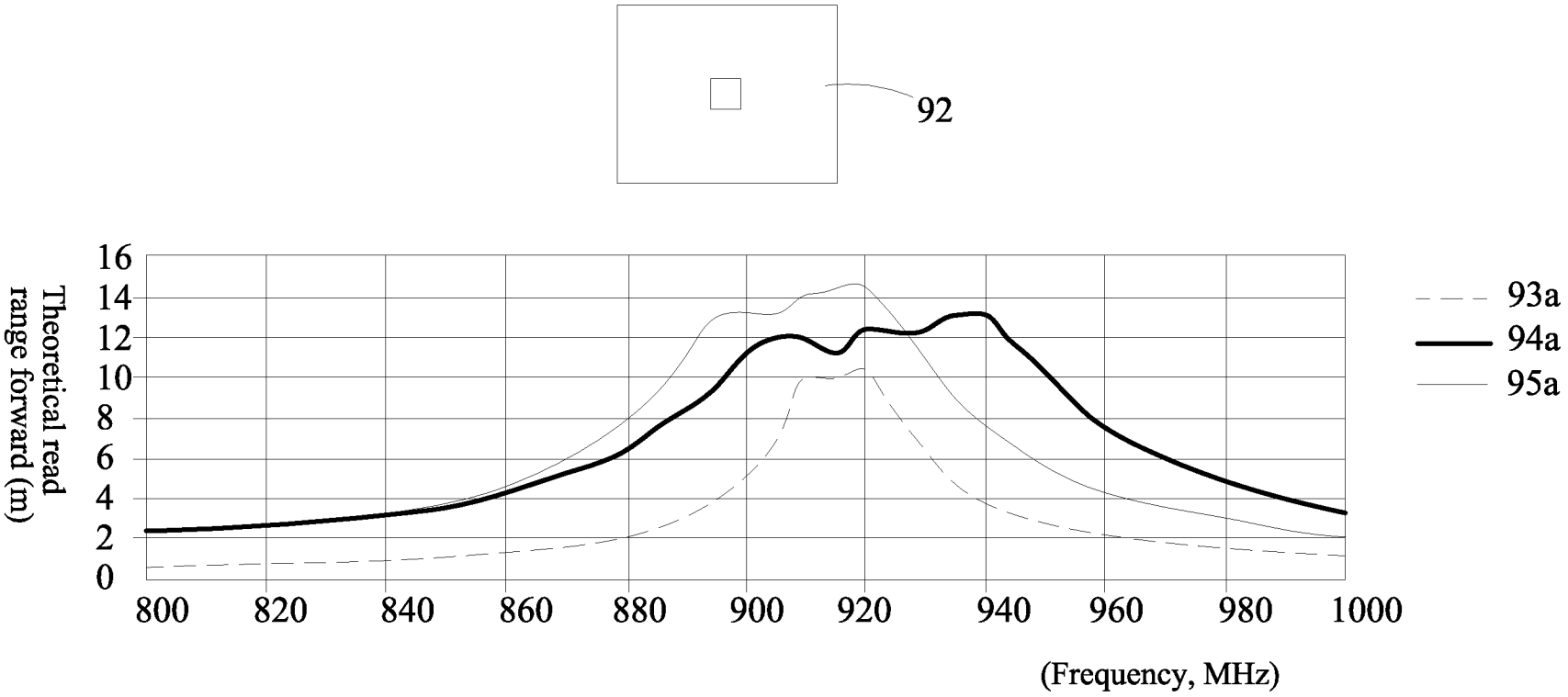
FIGS. 6A and 6B respectively illustrate relation curves of the access distance and frequency range corresponding to different measuring positions of conventional PIFA antenna device and antenna device of the present invention interrogated by the RFID reader directly facing the front surface having the antenna device.

The effect of the antenna device of the present invention is described hereinafter. Please refer to FIG. 6A, which illustrates relation curves respectively representing the interrogating distance and accessing frequency of the convention PIFA antenna device 1 shown in FIG. 1A, and the antenna device 3 shown in FIG. 5B and antenna device 3*b* of the present invention. In the testing result, the antenna device 1, 3, or 3*b* is respectively arranged at a center position of metal object 92, such as a metal plate (15 cm×15 cm), for example, and the RFID reader directly faces the antenna device and interrogates with the antenna device. In the drawing shown in FIG. 6A, the curve 93*a* represents relation between interrogating distance and accessing frequency of the antenna device 1 shown in FIG. 1A, the curve 94*a* represents relation between interrogating distance and accessing frequency of the antenna device 3 shown in FIG. 5B, and the curve 95*a* represents relation between interrogating distance and accessing frequency of the antenna device 3*b* shown in FIG. 5E.

According to the testing result, the peak of the accessing distance of the antenna device 1 is 10 meter and the accessing frequency corresponding to the peak of the accessing distance of the antenna device 1 is corresponding to the specification of American accessing frequency ranged between 902~928 MHz. The peak of the accessing distance of the antenna device 3 is 12.2 meter and the accessing frequency corresponding to the peak of the accessing distance of the antenna device 3 is corresponding to the specification of American accessing frequency ranged between 902~928 MHz. The peak of the accessing distance of the antenna device 3*b* is 14.3 meter and the accessing frequency corresponding to the peak of the accessing distance of the antenna device 3*b* is corresponding to the specification of American accessing frequency ranged between 902~928 MHz. According to the testing result, whether the farthest distance of interrogation or accessing frequency range, it is clear that results of the antenna device 3 and 3*b* are superior to the antenna device 1 shown in FIG. 1A.

Figure 1A:
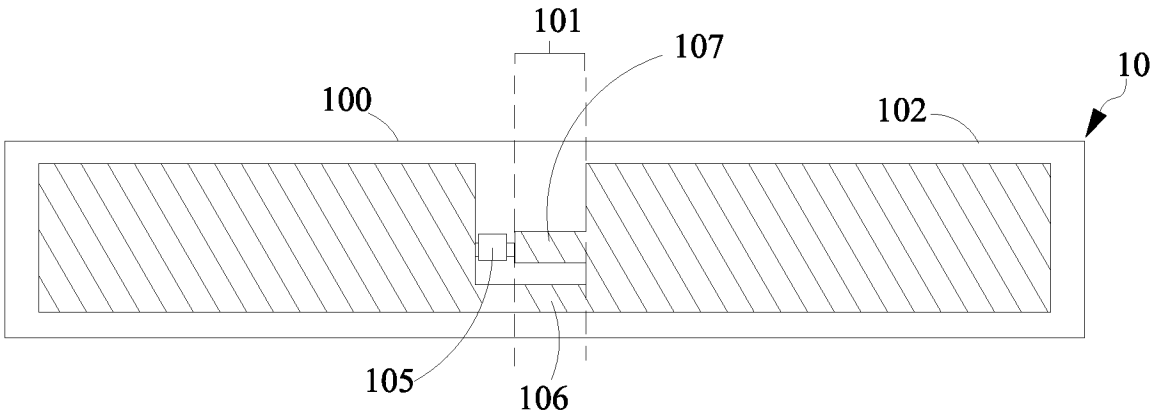
FIGS. 1A and 1B illustrates conventional antenna structure and antenna device applied in the UHF frequency range.
Figure 1B:
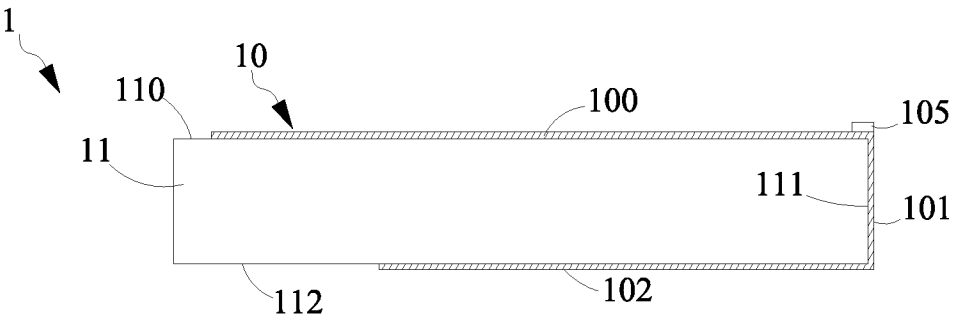
Figure 6B:
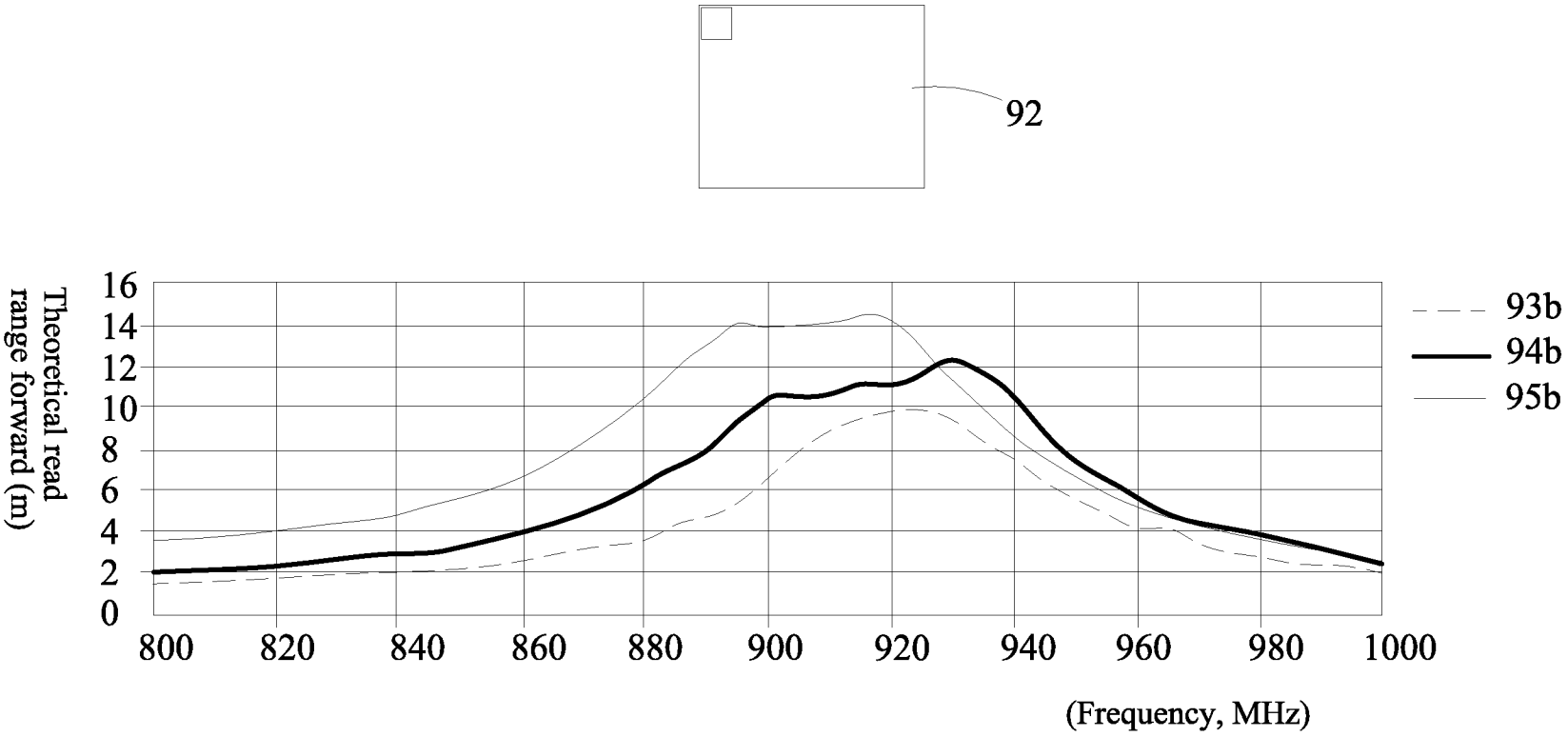

Please refer to FIG. 6B, which illustrates relation curves respectively representing the interrogating distance and accessing frequency of the convention PIFA antenna device 1 shown in FIG. 1A, and the antenna device 3 shown in FIG. 5B and antenna device 3*b* of the present invention. In the testing result, the antenna device 1, 3, or 3*b* is respectively arranged at an edge position of metal object 92, such as a metal plate (15 cm×15 cm), for example, and the RFID reader directly faces the antenna device and interrogates with the antenna device. In the drawing shown in FIG. 6B, the curve 93*b* represents relation between interrogating distance and accessing frequency of the antenna device 1 shown in FIG. 1A, the curve 94*b* represents relation between interrogating distance and accessing frequency of the antenna device 3 shown in FIG. 5B, and the curve 95*b* represents relation between interrogating distance and accessing frequency of the antenna device 3*b* shown in FIG. 5E.

According to the testing result, the peak of the accessing distance of the antenna device 1 is 10 meter and the accessing frequency corresponding to the peak of the accessing distance of the antenna device 1 is corresponding to the specification of American accessing frequency ranged between 902~928 MHz. The peak of the accessing distance of the antenna device 3 is 12.2 meter and the accessing frequency corresponding to the peak of the accessing distance of the antenna device 3 is corresponding to the specification of American accessing frequency ranged between 902~928 MHz. The peak of the accessing distance of the antenna device 3*b* is 14.3 meter and the accessing frequency corresponding to the peak of the accessing distance of the antenna device 3*b* is corresponding to the specification of American accessing frequency ranged between 902~928 MHz. According to the testing result, whether the farthest distance of interrogation or accessing frequency range, it is clear that results of the antenna device 3 and 3*b* are superior to the antenna device 1 shown in FIG. 1A.

Figure 6C:
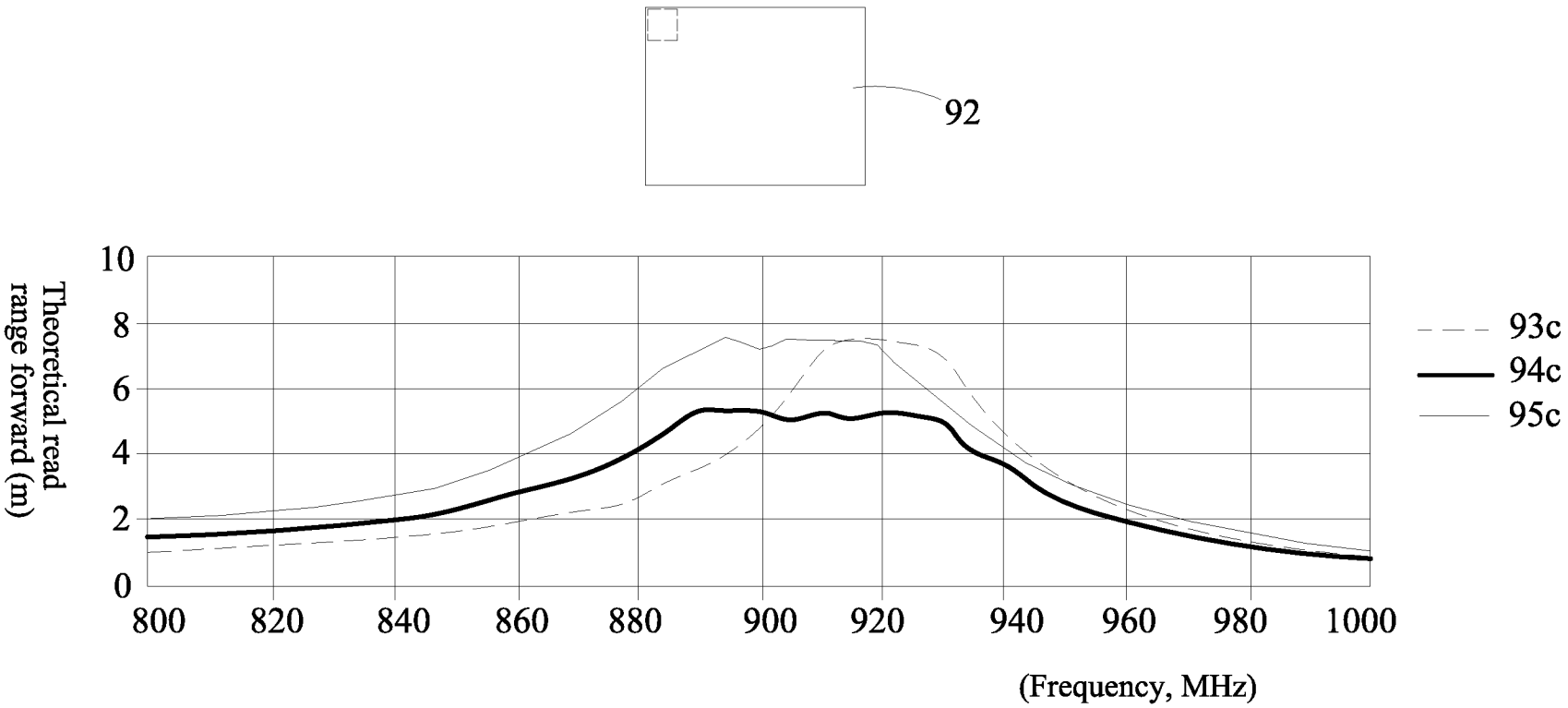
FIGS. 6C and 6D respectively illustrate relation curves of the access distance and frequency range corresponding to different measuring positions of conventional PIFA antenna device and antenna device of the present invention interrogated by the RFID reader directly facing the back surface opposite to the front surface having the antenna device.

Please refer to FIG. 6C, which illustrates relation curves respectively representing the interrogating distance and accessing frequency of the convention PIFA antenna device 1 shown in FIG. 1A, and the antenna device 3 shown in FIG. 5B and antenna device 3*b* of the present invention. In the testing result, the antenna device 1, 3, or 3*b* is respectively arranged at an edge position of the front side of metal object 92, such as a metal plate (15 cm×15 cm), for example, and the RFID reader faces the back side opposite to the front side of the metal object and interrogates with the antenna device. In the drawing shown in FIG. 6C, the curve 93*c* represents relation between interrogating distance and accessing frequency of the antenna device 1 shown in FIG. 1A, the curve 94*c* represents relation between interrogating distance and accessing frequency of the antenna device 3 shown in FIG. 5B, and the curve 95*c* represents relation between interrogating distance and accessing frequency of the antenna device 3*b* shown in FIG. 5E.

According to the testing result, the peak of the accessing distance of the antenna device 1 is 7.5 meter and the accessing frequency corresponding to the peak of the accessing distance of the antenna device 1 is corresponding to the specification of American accessing frequency ranged between 902~928 MHz. The peak of the accessing distance of the antenna device 3 is 5.2 meter and the accessing frequency corresponding to the peak of the accessing distance of the antenna device 3 is corresponding to the specification of American accessing frequency ranged between 902~928 MHz. The peak of the accessing distance of the antenna device 3*b* is 7.5 meter and the accessing frequency corresponding to the peak of the accessing distance of the antenna device 3*b* is corresponding to the specification of American accessing frequency ranged between 902~928 MHz. According to the testing result, whether the farthest distance of interrogation or accessing frequency range, it is clear that results of the antenna device 3*b* are superior to the antenna device 1 shown in FIG. 1A.

Figure 6D:
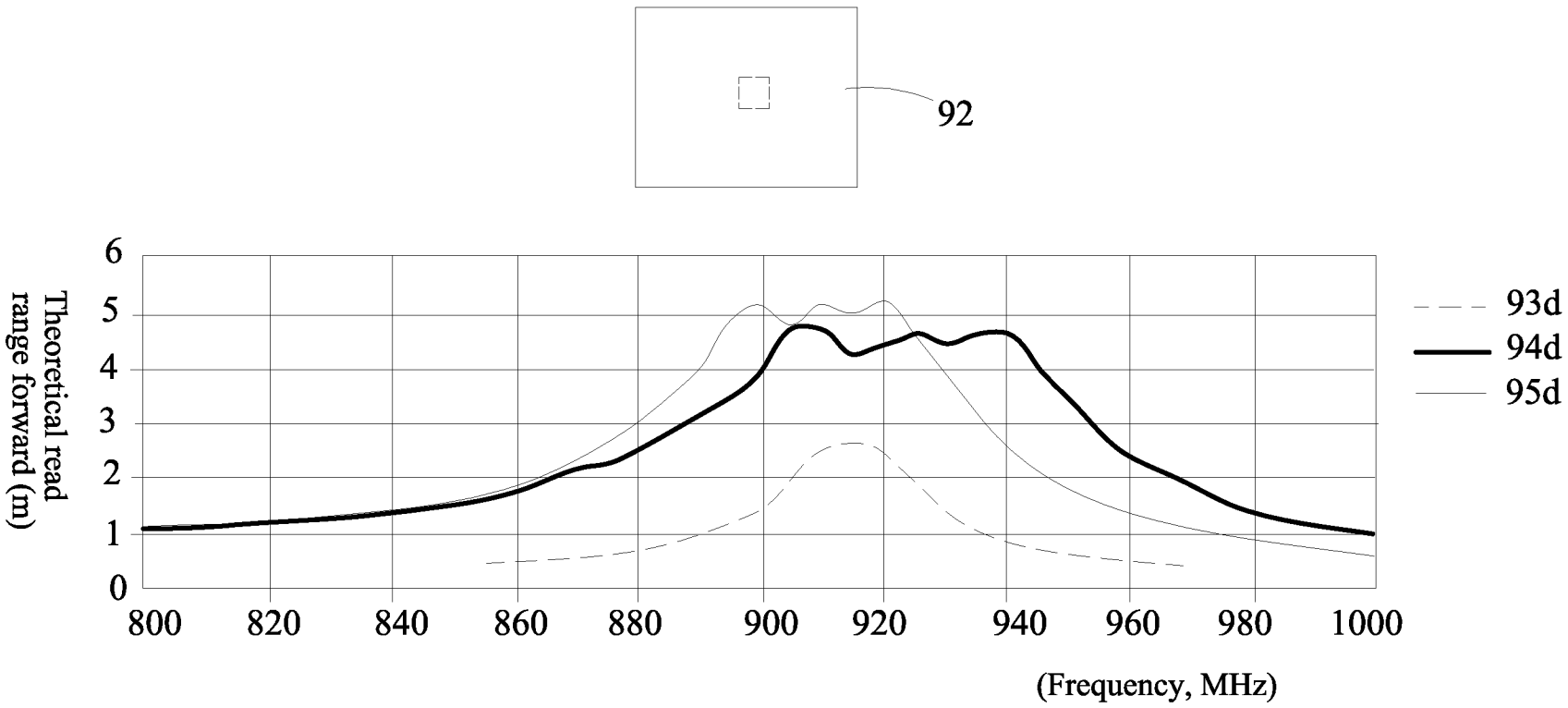

Please refer to FIG. 6D, which illustrates relation curves respectively representing the interrogating distance and accessing frequency of the convention PIFA antenna device 1 shown in FIG. 1A, and the antenna device 3 shown in FIG. 5B and antenna device 3*b* of the present invention. In the testing result, the antenna device 1, 3, or 3*b* is respectively arranged at a center position of the front side of metal object 92, such as a metal plate (15 cm×15 cm), for example, and the RFID reader faces the back side opposite to the front side of the metal object and interrogates with the antenna device. In the drawing shown in FIG. 6D, the curve 93*d* represents relation between interrogating distance and accessing frequency of the antenna device 1 shown in FIG. 1A, the curve 94*d* represents relation between interrogating distance and accessing frequency of the antenna device 3 shown in FIG. 5B, and the curve 95*d* represents relation between interrogating distance and accessing frequency of the antenna device 3*b* shown in FIG. 5E.

According to the testing result, the peak of the accessing distance of the antenna device 1 is 2.6 meter and the accessing frequency corresponding to the peak of the accessing distance of the antenna device 1 is corresponding to the specification of American accessing frequency ranged between 902~928 MHz. The peak of the accessing distance of the antenna device 3 is 4.8 meter and the accessing frequency corresponding to the peak of the accessing distance of the antenna device 3 is corresponding to the specification of American accessing frequency ranged between 902~928 MHz. The peak of the accessing distance of the antenna device 3*b* is 5.2 meter and the accessing frequency corresponding to the peak of the accessing distance of the antenna device 3*b* is corresponding to the specification of American accessing frequency ranged between 902~928 MHz. According to the testing result, whether the farthest distance of interrogation or accessing frequency range, it is clear that results of the antenna device 3*b* are superior to the antenna device 1 shown in FIG. 1A.

Figure 7A:
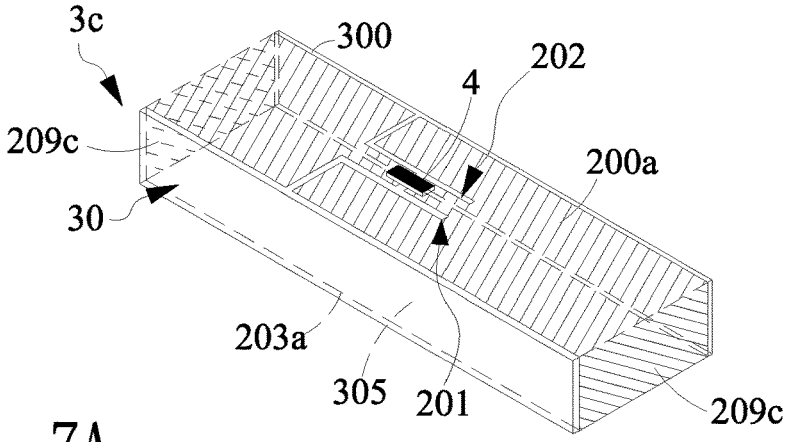
FIGS. 7A to 7C respectively illustrate antenna device according to another embodiment of the present invention.

It is noted that although the radiating conductor, ground conductor and the connecting conductor is formed on the flexible substrate 5 and the flexible substrate 5 is stuck onto the substrate 30 in the previous embodiment, it will not be a limitation of the present invention. For example, alternatively, please refer to FIG. 7A, the antenna device 3*c* has antenna structure formed onto the substrate 30 wherein the material of the radiating conductor 200*a*, ground conductor 203*a*, and connecting conductor 209*c* is metal material directly formed onto the substrate through printing process, electroplating process, or coating process. For example, firstly, the radiating conductor 200*a* and ground conductor 203*a* are formed onto the first surface 300 and the second surface 305. Then, the connecting conductors 209*c* connected to the radiating conductor 200*a* and ground conductor 203*a* are respectively formed onto two lateral surfaces of the substrate 30.

Figure 7B:
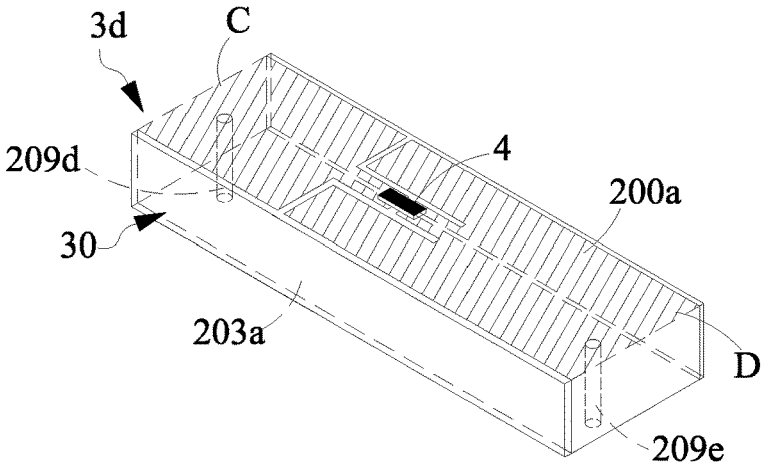

Alternatively, in the embodiment shown in FIG. 7B, there are no connecting conductors formed at lateral surfaces of the substrate. The first connecting conductor 209*d* and the second connecting conductor 209*e* are via conductors through the substrate 30. Each via conductor is a through hole having metal conductor filled therein such that the radiating conductor 200*a* and ground conductor 203*a* can be electrically connected to each other through the via conductors 209*d* and 209*e*. In the present embodiment, the first connecting conductor 209*d* is formed near the third side C of the radiating conductor 200*a*, and the second connecting conductor 209*e* is formed near the fourth side D of the radiating conductor 200*a*.

Figure 7C:
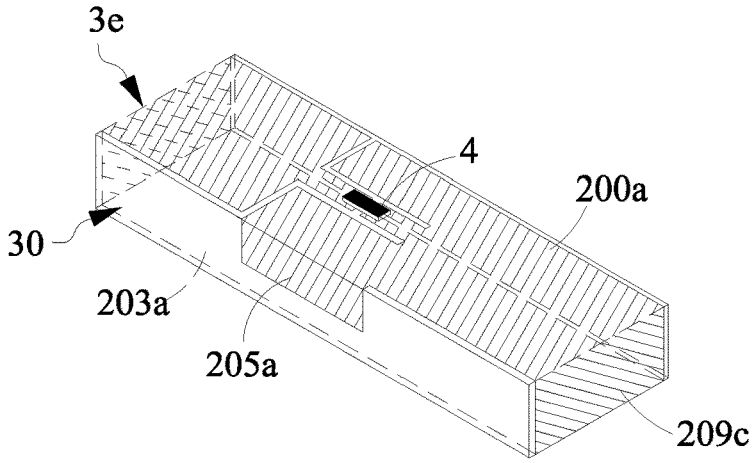

Alternatively, in the embodiment shown in FIG. 7C, the antenna device 3*e* further has conductive parts 205*a* and 206*a* respectively formed at two lateral sides of the substrate 30 through the electroplating process, coating process or printing process whereby at least four surfaces of the substrate 30 of the antenna device 3*e* can be covered by the antenna structure such that the radiating area can be increased.

According to the embodiments shown above, the antenna structure and device of the preset invention have opened structures formed on the radiating conductor whereby wavelength resonating with the antenna structure can be shortened thereby reducing the volume of the antenna structure. Besides, in addition to covering the surfaces of the substrate by the conductor part of the radiating conductor along the length direction, the radiating conductor further has conductor part along the width direction for covering the substrate thereby increasing radiating surface area such that the gain of antenna structure is strengthened to increase the interrogating distance between the RFID reader and RFID tag.

While the present invention has been particularly shown and described with reference to a preferred embodiment, it will be understood by those skilled in the art that various changes in form and detail may be without departing from the spirit and scope of the present invention.

What is claimed is:

1. An antenna device for metal environment, comprising:

a substrate comprising a first surface, a first lateral surface and a second lateral surface respectively connected to two lateral sides of the first surface along a first direction, a third lateral surface and a fourth lateral surface respectively connected to two lateral sides of the first surface along a second direction, and a second surface arranged opposite to the first surface along a third direction, and connected to the first lateral surface, the second lateral surface, the third lateral surface and the fourth lateral surface; and an antenna structure comprising:

a radiating conductor, formed on the first surface, the radiating conductor comprising a first hollow structure and a second hollow structure, wherein one end of the first hollow structure extends to a first side of the radiating conductor, and one end of the second hollow structure extends to a second side of the radiating conductor;

a first conductive part electrically connected to the first side of the radiating conductor and formed on the first lateral surface;

a second conductive part electrically connected to the second side of the radiating conductor and formed on the second lateral surface;

a ground conductor, electrically connected to the radiating conductor, formed on the second surface; and a first connecting conductor arranged between the radiating conductor and the ground conductor and formed on the third lateral surface, and a second connecting conductor arranged between the radiating conductor and the ground conductor and formed on the fourth lateral surface.

2. The antenna structure of claim 1, wherein the first conductive part and the second conductive part are symmetrically arranged at the first side and the second side of the radiating conductor respectively.

3. The antenna structure of claim 1, wherein the radiating conductor further comprises a third side and a fourth side opposite the third side, and the first and second hollow structures are symmetrically arranged at two separated sides of a central axis passing through respective centers of the third and fourth sides.

4. The antenna structure of claim 1, wherein the first hollow structure and the second hollow structure are respectively L-shaped structures.

5. The antenna structure of claim 1, wherein the radiating conductor further comprises a first power supplying conductive element and a second power supplying conductive element arranged between the first hollow structure and the second hollow structure.

6. The antenna structure of claim 1, wherein the ground conductor comprises a first ground conductor, and a second ground conductor, wherein the first ground conductor is electrically coupled to a third side of the radiating conductor, and the second ground conductor is electrically coupled to a fourth side of the radiating conductor.

7. The antenna structure of claim 6, wherein the first connecting conductor is arranged between the radiating conductor and the first ground conductor, and the second connecting conductor is arranged between the radiating conductor and the second ground conductor.

8. The antenna device of claim 1, further comprising:

a radio frequency chip electrically coupled to the antenna structure.

9. The antenna device of claim 8, wherein the first conductive part and the second conductive part are symmetrically arranged at the third lateral surface and the fourth lateral surface.

10. The antenna device of claim 8, wherein the radiating conductor further comprises a third side and a fourth side opposite to the third side, and the first and second hollow structures are symmetrically arranged at two separated sides of a central axis passing through respective centers of the third and fourth sides.

11. The antenna device of claim 8, wherein the first and second hollow structures are L-shaped structures.

12. The antenna device of claim 8, wherein the antenna structure is formed onto a flexible substrate, and the flexible substrate is stuck onto the substrate.

13. The antenna device of the claim 8, wherein the ground conductor comprises a first ground conductor, and a second ground conductor, wherein the first ground conductor is electrically coupled to a third side of the radiating conductor, and the second ground conductor is electrically coupled to a fourth side of the radiating conductor.

14. The antenna device of claim 13, wherein the first connecting conductor is electrically connected to the first ground conductor and the radiating conductor, and the second connecting conductor is electrically connected to the radiating conductor and the second ground conductor.

15. The antenna device of claim 8, wherein the antenna structure is formed by metal material directly formed onto surfaces of the substrate.

16. The antenna device of claim 5, wherein the first conductive part is directly connected to only the first side of the radiating conductor, and is free of any direct connection with the ground conductor or the first or second power supplying conductive elements.

* * * * *